United States Patent [19]

Hashimoto et al.

[11] 4,270,870

[45] Jun. 2, 1981

[54] MECHANICAL PENCIL WITH CHUCK CLOSING BY NORMAL WRITING GRIP

[75] Inventors: Yasuyuki Hashimoto, Nishinomiya; Osamu Torii, Kyoto, both of Japan

[73] Assignee: Ancos Co., Ltd., Osaka, Japan

[21] Appl. No.: 904,154

[22] Filed: May 9, 1978

[30] Foreign Application Priority Data

May 22, 1977 [JP] Japan ..... 52/59157
Nov. 15, 1977 [JP] Japan ..... 52/152939[U]

[51] Int. Cl.[3] ..... B43K 21/22; B43K 24/10

[52] U.S. Cl. ..... 401/93; 401/65; 401/82; 401/94

[58] Field of Search ..... 401/55, 65, 67, 80, 401/81, 82, 92–94, 99, 62

[56] References Cited

U.S. PATENT DOCUMENTS

| | | | |
|---|---|---|---|
| 223,498 | 1/1880 | Fraser | 401/94 |
| 269,724 | 12/1882 | Senn | 401/93 |
| 275,517 | 4/1883 | Pusey | 401/93 X |
| 1,518,822 | 12/1924 | Saadi | 401/99 X |
| 1,595,150 | 8/1926 | Greening | 401/62 |
| 1,716,354 | 6/1929 | Nelson | 401/65 X |
| 1,866,072 | 7/1932 | Woelm | 401/81 X |
| 2,340,665 | 2/1944 | Jacobs | 401/65 |
| 2,583,069 | 1/1952 | Votruba | 401/65 |
| 3,813,176 | 5/1974 | Kamo | 401/94 |
| 3,836,264 | 9/1974 | Saito et al. | 401/92 X |
| 3,883,253 | 5/1975 | Naruse et al. | 401/92 X |
| 3,914,059 | 10/1975 | Mitsuya | 401/67 |

FOREIGN PATENT DOCUMENTS

| | | | |
|---|---|---|---|
| 452723 | 6/1926 | Fed. Rep. of Germany | 401/82 |
| 1020256 | 11/1957 | Fed. Rep. of Germany | 401/94 |
| 775855 | 1/1935 | France | 401/65 |
| 399411 | 10/1942 | Italy | 401/65 |
| 19696 | of 1898 | United Kingdom | 401/93 |
| 2019 | of 1914 | United Kingdom | 401/92 |
| 1456115 | 11/1976 | United Kingdom | 401/67 |

*Primary Examiner*—Steven A. Bratlie
*Attorney, Agent, or Firm*—Sughrue, Rothwell, Mion, Zinn and Macpeak

[57] ABSTRACT

Mechanical pencil construction wherein the operational movements to advance the lead are accomplished by providing one or more elastically deformable ribs or spring biased cam members that extend outwardly through axial slots in the pencil body in the normal finger gripping area. The radially inward depression of such ribs or cam members by the writer's fingers is converted to axial motion within the pencil, to thereby effect the necessary lead gripping and advancing operations.

8 Claims, 12 Drawing Figures

MECHANICAL PENCIL WITH CHUCK CLOSING BY NORMAL WRITING GRIP

BACKGROUND OF THE INVENTION

This invention relates to new mechanical pencil constructions wherein the lead is advanced by utilizing the natural gripping force applied during writing by the operator's fingers.

In mechanical pencils wherein the lead is advanced by screwing the pencil axis, it is necessary to use both of the operator's hands, the advancement length is not constant, and thin leads may easily be broken if advanced too far.

In pencils wherein the lead is advanced by repeatedly depressing or thumb pumping the upper or eraser end of the pencil, the advancement length is constant and is accomplished by only one hand of the operator. In such pencils, however, it is necessary to vary the hand position in order to pump the upper end of the pencil.

In a pencil wherein a strip plate is provided in a middle portion of the pencil and the lead is advanced by finger pumping, one finger must depress the strip plate while the other fingers of the same hand support the pencil. This is an unnatural or difficult manipulation for the operator. See, for example, Japanese Utility Model Publication No. 51-17938.

There is also a known mechanical pencil in which the pencil axis is bent to advance the lead, but unnatural force application is also required in such a pencil. See, for example, Japanese Utility Model Publication No. 53-2034.

Further, pencils are known wherein the writing end is pumped against the paper or the like to advance the lead. This requires a hard support surface beneath paper, however, and the paper is easily punctured, torn or dotted.

SUMMARY OF THE INVENTION

Briefly, the present invention provides mechanical pencils in which fresh lead is easily and readily advanced only by depressing the middle portion of the pencil using the normal or natural writing grip. Therefore, according to the present invention, it is possible to automatically supply fresh lead simply by squeezing and releasing the pencil using only normal writing grip pressure and without changing the writer's finger grip. In the non-use of the pencils, even if accidental force or shock is applied to the lead, it is well protected because the lead is substantially freely movable. In one embodiment an elastic retaining ring is used to hold the movable tip sleeve in a retracted position during non-use, whereby the usual pocket clip cover is not necessary.

The operational movements of the invention are basically accomplished by providing one or more elastically deformable ribs or spring biased cam members that extend outwardly through axial slots in the pencil body in the normal finger gripping area. The radially inward depression of such ribs or cam members by the writer's fingers is converted to axial motion within the pencil, to thereby effect the necessary lead gripping and advancing operations.

DETAILED DESCRIPTION OF THE PREFERRED EMBODIMENTS

Figure 1:
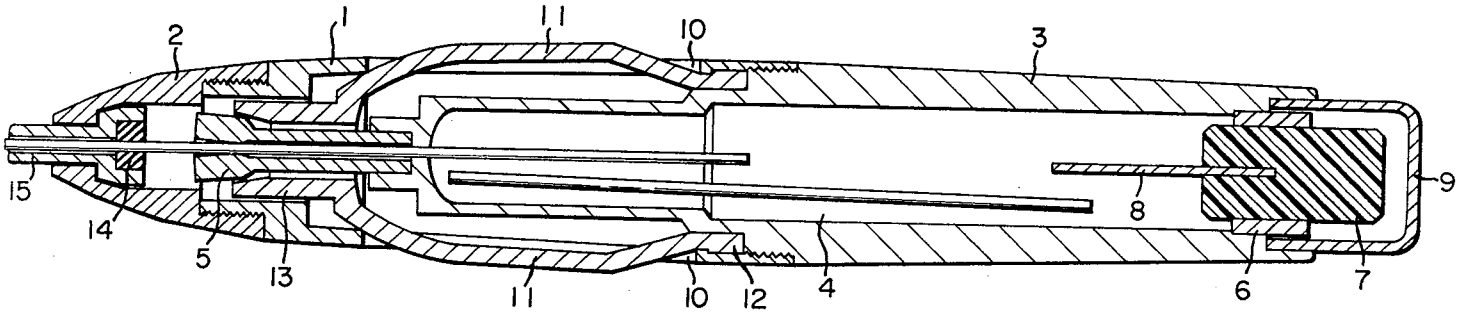
FIG. 1 shows a longitudinal sectional view of a mechanical pencil constructed in accordance with one embodiment of this invention, in a resting state.
Figure 2:
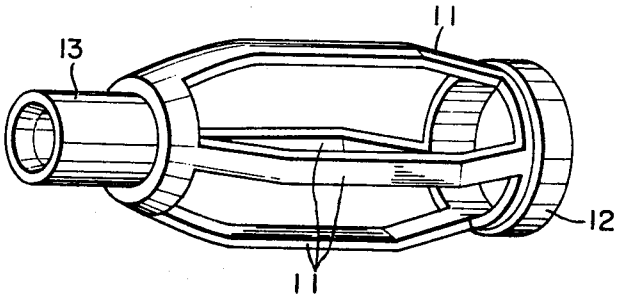
FIG. 2 shows a perspective view of the ribbed depressing member used in the pencil of FIG. 1.

FIGS. 1 and 2 show a preferred embodiment according to the invention. FIG. 1 shows a longitudinal sectional view of a mechanical pencil to which no force is applied. A mouth piece 2 is screw threaded to a front body member 1, and a rear body member 3 is inserted into the front body member 1 and screw threaded thereto at its mid portion. The rear body member 3 forms a reserve lead case 4, and a lead chuck 5 is inserted in the front end of the rear body member. The chuck has at least two slots therein to enable its outward expansion. An eraser 7 is inserted at the rear end of the rear body member 3, and has a cleaner pin 8 implanted therein. The eraser is covered by a cap 9. Four axial slots 10 are provided in the front body member 1, and a depressing member 11 in the form shown in FIG. 2 is installed therein.

The depressing member has outwardly arcuate rib portions that partially extend through the slots 10. The front closing portion 13 of the depressing member surrounds the chuck member 5, and the rear portion thereof is provided with a shouldered ring 12. The rib portions of the depressing member are resilient such that when they are depressed inwardly they retract to extend the front portion 13 in a longitudinal direction, and when they are released they are restored to their original shape. The ring 12 is firmly held between the front body member 1 and the rear body member 3 when they are screwed together.

A movable sleeve 15 having a lead retaining or holding member 14 mounted therein is disposed within the mouth piece 2. The lead holding member is made of elastic material such as rubber or synthetic resin to delicately hold the lead.

In operation, the pencil as shown in FIG. 1 is in a rest or released state, and hence no force is applied to the depressing member ribs. Since the chuck 5 is disengaged from the closing portion 13, the lead is disengaged from the chuck. Thus, if a cap member 24 having a holding clip 29 (shown in FIG. 3) is placed over the writing end in order to carry the pencil in a pocket, the writing end is directed upwardly so that the movable sleeve 15 drops down together with the lead due to gravity, whereby the writing end is retracted into the mouth piece.

In the writing state, the writing end of the pencil is naturally directed downwardly. The operator's fingers press the depressing member 11 so that the ribs thereof are retracted inwardly. Accordingly, the overall length of the depressing member increases to thereby advance the closing portion 13, which then engages and closes the chuck 5 to grip the lead. As writing is continued the lead is gradually abraded or worn away from the tip end thereof and then the movable sleeve 15 is retracted to the pencil body. In this state, if the rib depressing force is removed, the depressing member 11 is restored to its original shape due to its resiliency, whereby the closing portion 13 retreats to disengage the lead and the chuck. As soon as the lead is disengaged from the chuck the movable sleeve 15 is advanced together with the lead via holding member 14 by gravity, and the pencil is restored to the state shown in FIG. 1.

In the usual writing operation the rib portions remain depressed, and the lead tip is advanced when necessary by simply raising the pencil, releasing the rib portions, and then depressing them again to continue writing. Thus, the writer's grip position is not changed, and no thumb pushing is necessary.

The operation wherein a new lead stored in the lead case 4 is inserted through the chuck 5 and into the movable sleeve 15 is achieved as follows. First, the pencil is directed downwardly so that the new lead drops by gravity through the relaxed chuck to abut the rear end of the lead holding member 14. The rib portions are then depressed to engage the chuck, and the sleeve 15 is then pushed against the writing paper or the like to force it up into the mouth piece 2 and at the same force the new lead, still gripped by the chuck 5, down through the sleeve. In this state, if the rib depressing force is released and the pencil is raised off of the paper, the lead and sleeve are advanced by gravity.

Those operations are then repeated as necessary to advance the new lead to the writing position shown in FIG. 1. Of course, during use the sleeve 15 is gradually cammed up into the mouth piece by the writing paper as the lead is worn away, to thereby always automatically expose a good writing tip.

In the above embodiment, a spring or a magnet may be provided between the movable sleeve 15 and the mouth piece 2 in order to urge the movable sleeve to protrude from the mouth piece. By the provision of each a spring or a magnet, the returning action of the movable sleeve 15 is quickly carried out when the chuck 5 releases the lead.

Figure 3:
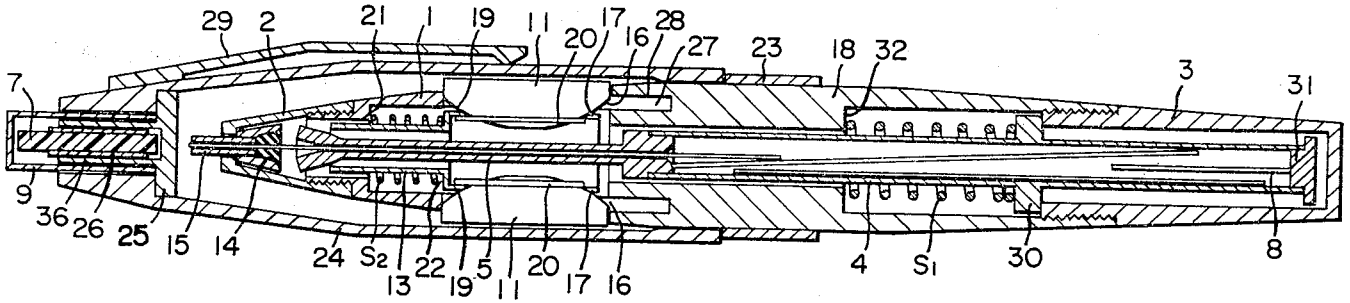
FIG. 3 shows a longitudinal sectional view of a further embodiment, in a resting state.
Figure 4:
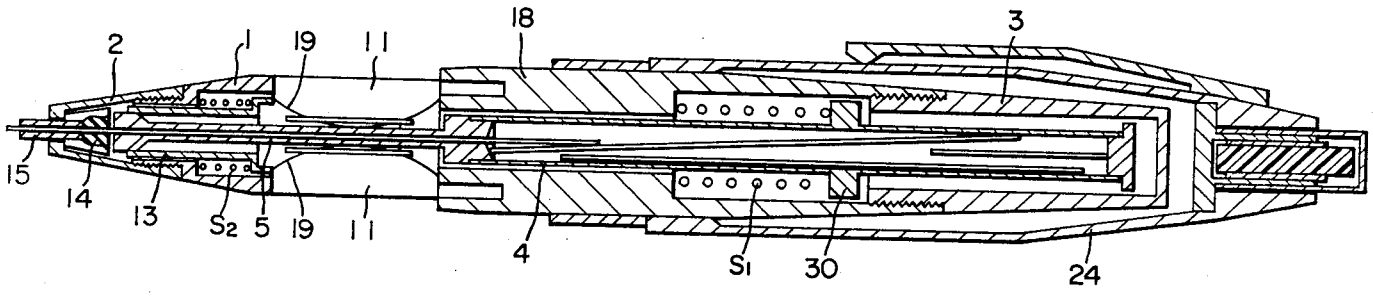
FIG. 4 shows the pencil of FIG. 3 in a writing state.

FIGS. 3 and 4 show another embodiment of the invention. FIG. 3 shows the pencil in a non-use or carrying state. A front body member 1 is provided with a male screw thread at its outer front end, with an inner shoulder 21 and with at least one axial slot 16. A mouth piece 2 is screw threaded onto the front body member 1. A middle body member 18 is connected to the front body member 1 by frictionally inserting extensions 27 of the front body member into grooves 28 in the middle body member. A shoulder 32 is provided to the middle body member, and a rear body member 3 is screw threaded to the middle body member.

A flange 30 is provided at a middle portion of lead case 4. A spring $S_1$ is disposed between the shoulder 32 of the middle body member 18 and the flange 30 of the lead case, and a plug cap 31 is inserted into the rear end of the lead case. A cleaning pin 8 is implanted into the plug cap. An elongated chuck 5 is inserted into the front end of the lead case, and the chuck 5 is provided with at least two slots therein to enable its opening and closing.

A chuck closing member 13 surrounds the front outer periphery of the chuck. The closing member is in the form of a hollow cylinder or sleeve which is step enlarged at shoulder 22 to have a small front diameter portion and a large rear diameter portion. The large rear portion is provided with slots 17. A spring $S_2$ is disposed between the shoulder 22 of the closing member and the shoulder 21 of the front body member, whereby the chuck closing member 13 is urged backwardly.

Depressing members 11 are inserted into slots 16 of the front body member 1 and slots 17 of the chuck closing member 13. The depressing members have arcuate cam surfaces 19 and are provided with stop portions 20 which prevent their disengagement from the pencil body. A movable sleeve 15 having a lead retaining member 14 is slidably inserted into the mouth piece 2.

A decoration ring 23 is provided around the outer peripheral portion of the middle body member 18, and a closing cap 24 is in abutment with the ring 23. A washer 25 has an extending sleeve portion 36 to hold an eraser 7 mounted in an eraser holding member 26. An eraser cap 9 is provided around the sleeve portion 36, and the cap 24 has a pocket clip 29.

In operation, the lead case 4 is moved backwardly by the spring $S_1$, and the chuck closing member 13 is moved backwardly by the spring $S_2$ to open the chuck 5. In this condition, when the pencil is carried in a pocket the writing end is directed upwardly, and the movable sleeve 15 drops down by gravity so that its rear end abuts the front end of the chuck.

FIG. 4 shows the writing state. To achieve this the depressing members 11 are depressed by the operator's fingers into the pencil body to cam the chuck closing member 13 forward against the force of the spring $S_2$. The chuck closing member thus engages the chuck 5 to grip the lead. The chuck closing member 13, the lead case 4 and the chuck 5 are thus simultaneously advanced against the forces of springs $S_1$ and $S_2$. Since the movable sleeve 15 is in abutment with the inner portion of the mouth piece 2, the lead can be slidingly moved ahead through the lead retaining member 14.

FIG. 4 shows the state wherein the chuck 5, the chuck closing member 13 and the like are fully advanced to the writing position. In this state the chuck closing member 13 firmly clamps the chuck 5 to thereby grip the lead. When the force depressing the members 11 is removed or released the chuck 5 and the closing member 13 are integrally moved backwardly a predetermined distance with the chuck still clamped by the closing member. The lead and the sleeve 15 are also moved backwardly the same distance since the lead is gripped by the retaining member 14. The lead case 4 stops moving backwardly when its flange 30 abuts the front end of the rear body member 3, whereas the spring $S_2$ moves the closing member 13 further back to thereby release the chuck 5. Since the writing end is directed downwardly the movable sleeve 15 is advanced by gravity to its extended position when the chuck releases the lead. A new lead slides into the chuck 5 as the old lead is worn away.

The new lead may be advanced by squeezing and releasing the depressing members 11.

Figure 5:
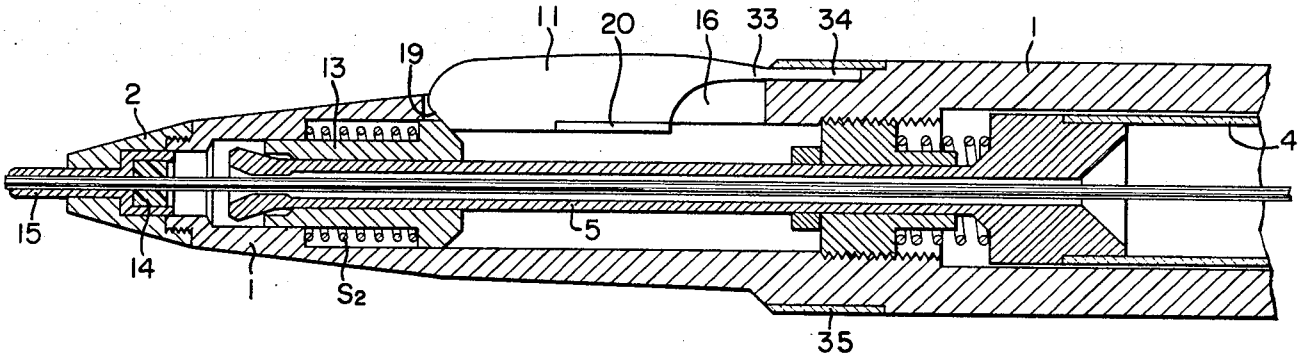
FIG. 5 shows a partial longitudinal sectional view of a further embodiment, in a resting state.
Figure 6:
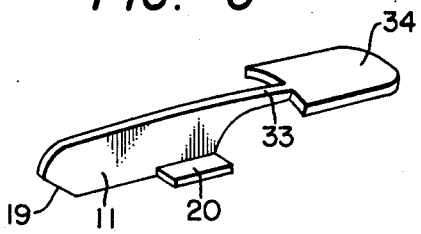

FIG. 5 shows another embodiment in which a modified depressing member 11 is employed, whose configuration is shown in FIG. 6. The depressing member is secured to a modified front body member 1 by a securing ring 35 overlying a supporting portion 34 of the depressing member. A hinge portion 33 is provided with elasticity. When the member 11 is depressed toward the pencil body, the hinge portion 33 is bent to thereby advance the chuck closing member 13 via a cam surface 19 of the depressing member. By this construction, the slots 17 of the chuck closing member shown in FIGS. 3 and 4 can be omitted.

Figure 7:
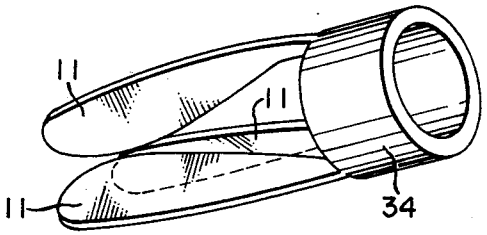
FIGS. 6 and 7 show perspective views of depressing members which may be used with the pencil of FIG. 5, FIGS. 8 and 9 show longitudinal sectional views of a further embodiment, in resting and writing states, respectively.

As is apparent, a further modified depressing member as shown in FIG. 7 having a plurality of depressing ribs and a ring-like supporting portion 34 can be employed. With this embodiment the stop portion 20 can be omitted.

Figure 8:
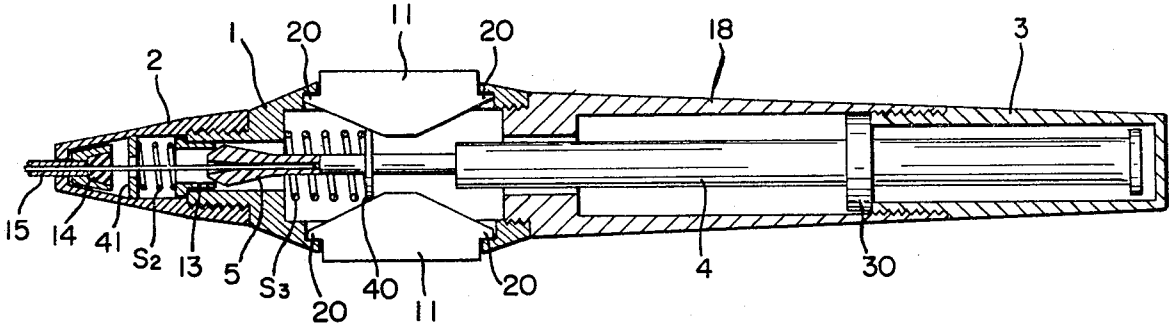
Figure 9:
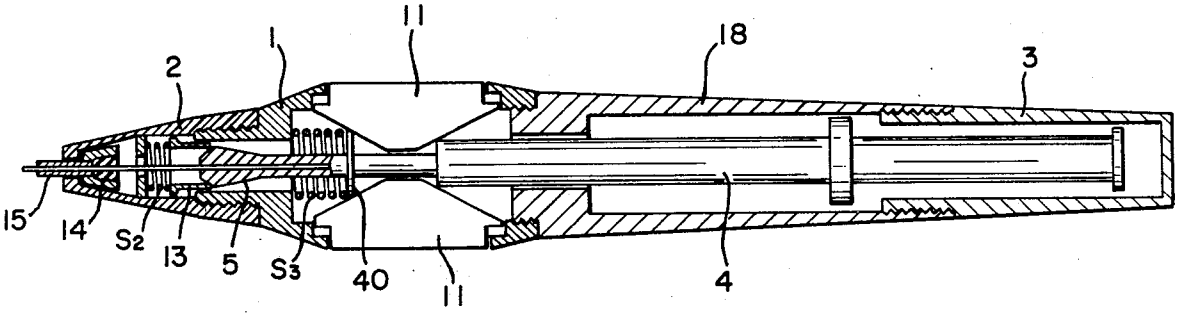

FIGS. 8 and 9 show a still another embodiment wherein the chuck 5 rather than the chuck closing member 13 is advanced by the depression of the members 11 to obtain the same operative effect. A flange 40 is fixedly provided on the chuck 5 and spring $S_3$ is disposed between the inner side of the front body member 1 and the flange 40 to thereby urge the chuck 5 inwardly. An apertured ring 41 is inserted within the mouth piece 2, and the chuck closing member 13 is disposed behind the ring. The spring $S_2$ is disposed between the ring 41 and the closing member 13. In the state shown in FIG. 9, when the members 11 are depressed toward the pencil body, the chuck 5 is advanced via the flange 40 to thereby engage the chuck with the closing member. The operation thereafter is the same as in the aforementioned embodiments.

Figure 10:
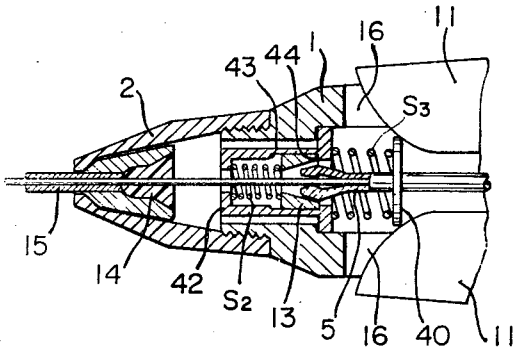
FIG. 10 shows a partial longitudinal sectional view of a further embodiment, in a resting state.

FIG. 10 shows a further embodiment similar to that of FIGS. 8 and 9. A receiving member 42 for the chuck closing member is fixedly secured to the front body member 1, and the closing member 13 is slidably disposed within the receiving member. The movement of the closing member is limited between opposing shoulders 43 and 44 of the receiving member 42.

Figure 12:
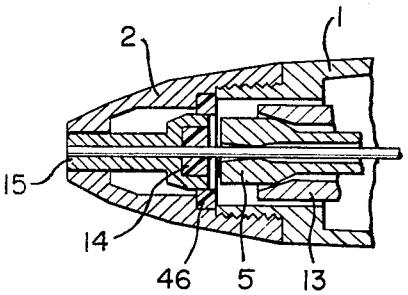
FIG. 12 shows a partial view of the pencil of FIG. 11, with the movable tip sleeve in a retracted position.
Figure 11:
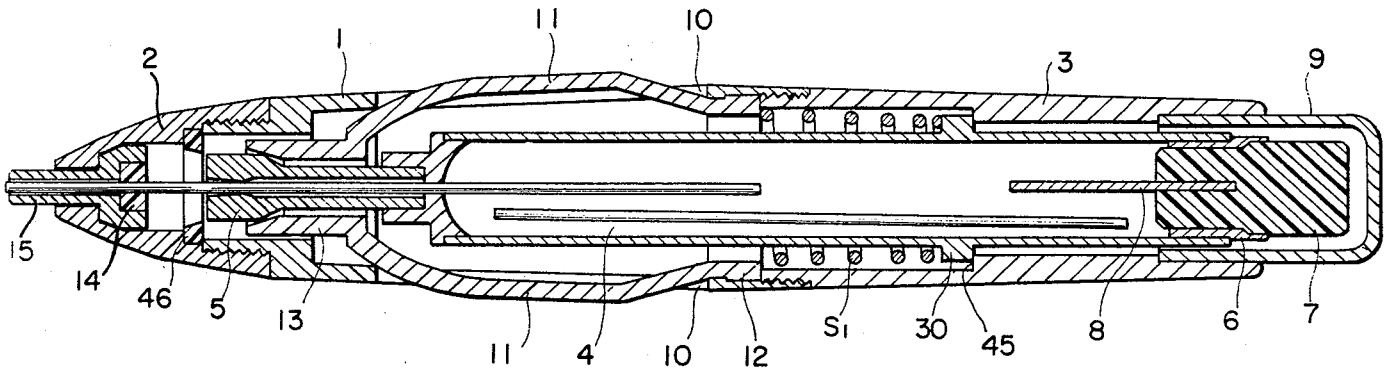
FIG. 11 shows a longitudinal sectional view of a still further embodiment, in a resting state.

FIGS. 11 and 12 show a further embodiment of the invention. In the previous embodiments it was necessary to maintain the writing end directed upwardly in order to keep the sleeve 15 retracted into the mouth piece 2. In this embodiment, however, it is possible to maintain the sleeve retracted by a retaining member 46. A flange 30 is provided around the outer peripheral portion of the lead case, and the spring $S_1$ is disposed between the depressing members 11 and the flange 30 to urge the lead case inwardly. A shoulder 45 is provided on the rear body member 3 to limit the rearward movement of the lead case. A ring-like retaining member 46 is provided on an inner peripheral portion of the mouth piece 2. The inner diameter of the retaining member is somewhat smaller than that of the outer rear diameter of the movable sleeve 15. The retaining member is made of an elastic material such as rubber, synthetic resin or the like. With this construction, when the movable sleeve 15 is retracted into the mouth piece 2, the retaining member 46 grips and holds the sleeve as shown in FIG. 12.

It is possible to release the engagement between the retaining member 46 and the sleeve 15 by only slightly depressing the member 11. After the engagement of the closing member 13 and the chuck 5, the chuck and the lead case 4 are advanced toward the movable sleeve 15 against the spring $S_1$, and further advancement pushes the sleeve to thereby release its engagement. In this embodiment the retaining member 46 is secured to the mouth piece 2. It is apparent that the retaining member 46 can also be secured to the movable sleeve 15 to obtain the same effect. The shape or configuration of the retaining member 46 can take a number of forms.

Although the cap 9 is mounted on the rear body member 3 in the aforementioned embodiments, it is also possible to mount the cap 9 on the lead case 4, whereby the chuck 5 may also be advanced by depressing the cap 9.

In any of the embodiments, a spring or a magnet may be provided between the movable sleeve 15 and the mouth piece 2 in order to urge the movable sleeve to protrude from the mouth piece. By the provision of such a spring or a magnet, the return movement of the movable sleeve 15 is quickly achieved when the chuck 5 releases the lead.

What is claimed is:

1. A mechanical pencil, comprising:

(a) a hollow elongated body having at least one axial slot therein disposed in the normal finger gripping area of the body, (b) a slotted resilient chuck disposed in said body for gripping a pencil lead when closed and for releasing said lead when open, said chuck being selfbiased to an open state, (c) a chuck closing collar disposed in said body for cammingly engaging said chuck to close same, (d) a depressable member disposed in said slot and biased to extend radially outwardly through said slot, and (e) means for converting the radially inward depression of said member into linear axial relative movement between said chuck and said collar, whereby the normal gripping of said pencil pursuant to the commencement of writing inherently inwardly depresses said member to thereby cause the chuck to grip the lead.

2. A pencil as defined in claim 1, further comprising an axially movable protective sleeve slidably disposed in said body and extending outwardly through the writing tip end thereof, and a resilient retaining member mounted on the interior end of said sleeve for slidably frictionally gripping the lead.

3. A pencil as defined in claims 1 or 2, wherein there are a plurality of circumferentially spaced axial slots in said body, said depressable member comprises a resilient elastic rib cage structure having an annular rear portion fixedly secured to the body, the ribs of said structure individually extend outwardly through the respective slots, and the closing collar surrounds the chuck and is secured to the front portion of said structure.

4. A pencil as defined in claims 1 or 2, wherein there are a plurality of circumferentially spaced axial slots in said body, said depressable member comprises a plurality of plate members individually extending outwardly through the respective slots and having inner cam surfaces, said closing collar surrounds the chuck and the rear portion of said collar serves as a follower and is spring biased against said cam surfaces, and said chuck is fixedly secured to a lead case spring biased toward the rear of the body.

5. A pencil as defined in claims 1 or 2, wherein said depressable member comprises a resilient elastic plate member having its rear portion fixedly secured to the body and a cam surface defined on its inner front portion, said closing collar surrounds the chuck and the rear portion of said collar serves as a follower and is spring biased against said cam surface, and said chuck is fixedly secured to a lead case spring biased toward the rear of the body.

6. A pencil as defined in claim 5, wherein there are a plurality of circumferentially spaced axial slots in said body, and there are a plurality of said plate members individually disposed in the respective slots.

7. A pencil as defined in claims 1 or 2, wherein there are a plurality of circumferentially spaced axial slots in said body, said depressable member comprises a plurality of plate members individually extending outwardly through the respective slots and having inner cam surfaces, a follower disc is fixedly secured to said chuck and spring biased against said cam surfaces, and said closing collar is spring biased towards the mouth of said chuck.

8. A pencil as defined in claim 2, further comprising a resilient elastic retaining ring mounted within said body for frictionally gripping said protective sleeve to loosely retain it in a retracted position, wherein said chuck is fixedly secured to a lead case spring biased toward the rear of the body.

* * * * *